US005783937A

United States Patent [19]

Perraud

[11] Patent Number: 5,783,937

[45] Date of Patent: Jul. 21, 1998

[54] REFERENCE VOLTAGE GENERATOR CONTROLLED AS A FUNCTION OF TEMPERATURE

[75] Inventor: Jean-Claude Perraud, Saint-Aubin/Mer, France

[73] Assignee: U.S. Philips Corporation, New York, N.Y.

[21] Appl. No.: 881,349

[22] Filed: Jun. 24, 1997

[30] Foreign Application Priority Data

Jun. 26, 1996 [FR] France ..... 96 07941

[51] Int. Cl.[6] ..... G05F 3/20

[52] U.S. Cl. ..... 323/315; 323/314

[58] Field of Search ..... 323/312, 313, 323/314, 315, 316

[56] References Cited

U.S. PATENT DOCUMENTS 4,396,883 8/1983 Holloway et al. ..... 323/313
5,057,792 10/1991 Gay ..... 323/315 X
5,570,008 10/1996 Goetz ..... 323/315
5,581,174 12/1996 Fronen ..... 323/316

FOREIGN PATENT DOCUMENTS

0656575A1 6/1995 European Pat. Off. .

*Primary Examiner*—Peter S. Wong
*Assistant Examiner*—Y. J. Han
*Attorney, Agent, or Firm*—Robert McDermott

[57] ABSTRACT

This invention relates to a reference voltage generator which provides for an optimum control of the output voltage as a function of temperature. The generator comprises two transistors, two current sources, two resistors, and a third transistor supplying current into a charge resistor. It also comprises, connected between the first and second transistors and the current sources, a pair of transistors whose bases are jointly connected to the base of the third transistor.

8 Claims, 2 Drawing Sheets

REFERENCE VOLTAGE GENERATOR CONTROLLED AS A FUNCTION OF TEMPERATURE

BACKGROUND OF THE INVENTION

1. Field of the Invention

The invention relates to a reference voltage generator which supplies a controlled output voltage at an output terminal, which generator comprises:

a first and a second transistor whose bases are interconnected and form the output terminal of the generator, the emitter of the first transistor being connected via a first resistor to the emitter of the second transistor, which latter emitter is also connected via a second resistor to a first supply terminal, while the collectors of the first and the second transistor are connected to two current sources of equal nominal values, a third transistor whose base is connected to one of the current sources, whose collector is connected to a second supply terminal, and whose emitter is connected to the bases of the first and the second transistor as well as to the negative supply terminal via a charge resistor.

2. Description of Related Art

Such a generator is described in a European Patent document registered under no. 94 203 440.6. This generator in particular has the function to provide a voltage at the bases of the first and the second transistor whose value does not vary as a function of the temperature. The theory underlying this type of system is known to those skilled in the art. It is based on the fact that the base-emitter voltage of a transistor decreases linearly as a function of the temperature. A voltage drop created by the first resistor, referenced VR1, renders it possible to increase the emitter potential in a linear manner as a function of the temperature. If the first transistor is N times greater than the second, the voltage VR1 is indeed equal to $Vt*\ln(N)$, with $Vt=K*T/q$, where K is Boltzmann's constant, q the charge of the electron, and T the absolute temperature. This accordingly results in $VR1=T*(\ln(N)*K/q)$. The linear decrease in the base-emitter voltage, written Vbe, as a function of the temperature in the first transistor may thus be compensated for by means of a suitable dimensioning of the components which form the generator. The latter functions optimally when the currents traversing the first and the second transistor are absolutely equal. Moreover, in order to prevent the Early effect from creating imbalances between said transistors, their collector voltages must also be identical, which is not the case in the generator described in the document cited above, in which the collectors exhibit a potential difference due to the base-emitter voltage of the third transistor, to which is added a voltage drop across the terminals of an additional resistor. This potential difference creates an imbalance which has the effect of altering the quality of the temperature compensation of the base-emitter voltage of the first transistor.

SUMMARY OF THE INVENTION

The present invention has for its object to counteract this disadvantage by providing a voltage generator in which the collector voltages of the first and the second transistor are rendered equal without using a complicated structure.

To achieve this object, a reference voltage generator according to the invention is characterized in that it comprises, inserted between the first and second transistors and the current sources, a fourth and a fifth transistor whose bases are jointly connected to the base of the third transistor, whose emitters are connected to the collectors of the first and the second transistor, respectively, and whose collectors are each connected to one of the current sources.

In such generator, each of the collectors of the first and second transistors is at a potential lower than the base voltage of the third transistor by a value Vbe. Moreover, each of the bases of the first and the second transistor is also at a potential lower than the base voltage of the third transistor by a value Vbe. The result of this is that the first and the second transistor both operate at a zero collector-emitter voltage, which is a particularly stable point of operation.

A variant of the invention provides a reference voltage generator as described above, characterized in that it comprises a first, a second, and a third current mirror, each comprising a first and a second branch and a supply point, the first branches of the first and the second current mirror being connected to the collectors of the fourth and the fifth transistor, respectively, while the supply points of the first and the second current mirror are connected to the second supply terminal, the second branches of the first and second current mirror are connected to the first and to the second branch, respectively, of the third current mirror, whose supply point is connected to the first supply terminal, and the bases of the first, the second, and the third transistor are jointly connected to one of the branches of the third current mirror.

Such a structure safeguards that the currents flowing through the first and the second transistor are equal, which is necessary for a good control of the output voltage as a function of the temperature. Moreover, this structure is very simple, so that the supply voltage for such a generator may have low values of the order of 2 volts.

Another variant of the invention provides a reference voltage generator such as described above and characterized in that it comprises a sixth transistor whose base is connected to the emitter of the third transistor and which is inserted between that one of the branches of the first or second current mirror which is not connected to the base of the third transistor and that one of the branches of the third current mirror which is not connected to the base of the third transistor.

Thanks to this additional transistor, the potentials of the second current branches of the first and the second current mirror are the same, being both equal to the output voltage to which is added a value Vbe, which further improves the equality of the currents running through the first and the second transistor.

Another variant of the invention provides a reference voltage generator as described above and characterized in that the third mirror current comprises a seventh, an eighth, a ninth, and a tenth transistor, the bases of the seventh and the eighth transistor being connected to their respective collectors and to the bases of the ninth and the tenth transistor, the emitters of the seventh and the ninth transistor being connected to the respective collectors of the eighth and the tenth transistor, of which the emitters are interconnected and constitute the supply point of the third current mirror, while the collectors of the seventh and the ninth transistor form the first and the second branch, respectively, of the third current mirror, the second branch of the third current mirror being connected to the base of the third transistor.

This structure of the third current mirror renders it possible to compensate in part the currents pulled from its second branch.

Another variant of the invention provides a generator as described above and characterized in that it comprises a starting module which enables it to evolve rapidly into a stabilized state after a supply voltage has been applied to it, which module comprises an eleventh and a twelfth transistor arranged as a differential pair, the collector of the eleventh transistor being connected to the positive supply terminal, the base of the eleventh transistor being connected to the bases of the third, the fourth, and the fifth transistor, the collector of the twelfth transistor being connected to the first branch of that one from the first and second current mirrors of which the second branch is connected to the base of the third transistor, while the base of the twelfth transistor receives a voltage of a nominal fixed value lower than the voltage which is applied to the bases of the third, fourth, and fifth transistors when the generator is in the nominal operational state.

Such a starting module provides a quick stabilization of the generator after it has been switched on.

BRIEF DESCRIPTION OF THE DRAWINGS

The invention will be better understood from the following description of a few embodiments, given by way of example, with reference to the annexed drawings, in which.

DESCRIPTION OF THE PREFERRED EMBODIMENTS

Figure 1:
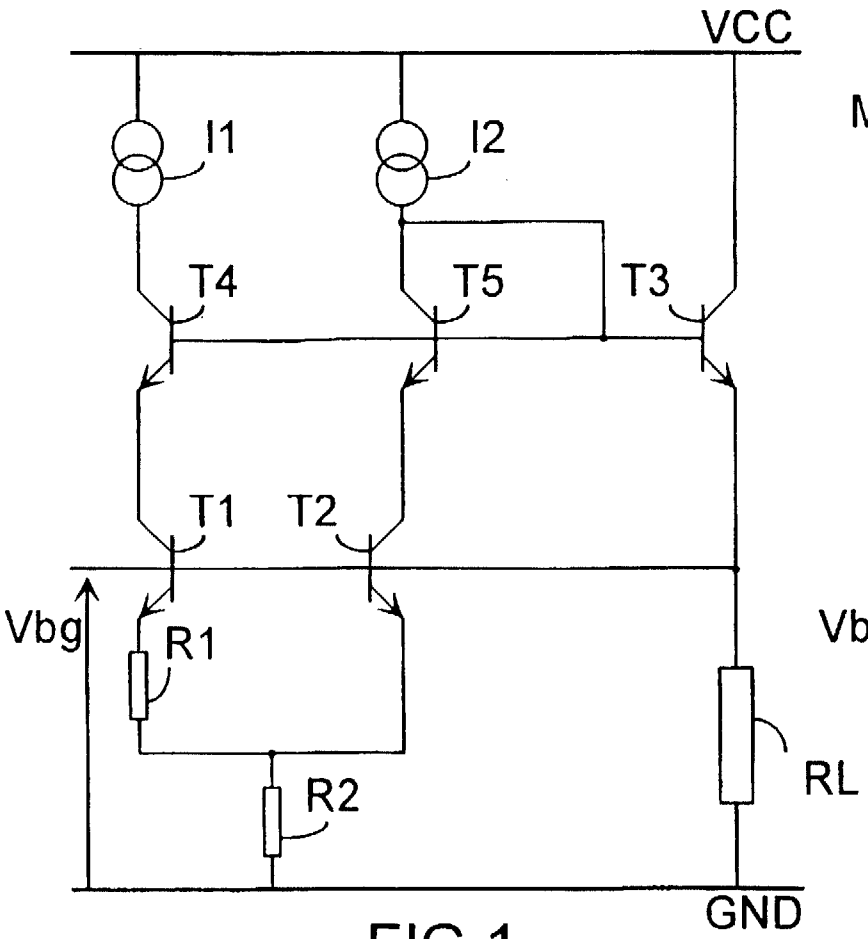
FIG. 1 is a circuit diagram representing a voltage generator according to the invention.

In FIG. 1, a reference voltage generator according to the invention, which supplies a controlled output voltage Vbg at an output terminal comprises:

a first and a second transistor (T1, T2), both of the NPN type, whose bases are interconnected and form the output terminal of the generator, while the emitter of the first transistor T1 is connected via a first resistor R1 to the emitter of the second transistor T2, which is in addition connected via a second resistor R2 to a first supply terminal GND, the collectors of the first and second transistors (T1, T2) being connected to two current sources of equal nominal values (I1, I2), a third transistor T3 of the NPN type whose base is connected to the current source I2, whose collector is connected to a second supply terminal VCC, and whose emitter is connected to the bases of the first and the second transistor (T1, T2) as well as to the negative supply terminal GND via a charge resistor RL. This generator in addition comprises, inserted between the first and second transistors (T1, T2) and the current sources (I1, I2), a fourth and a fifth transistor (T4, T5), both of the NPN type, whose bases are jointly connected to the base of the third transistor T3. Their emitters are connected to the collectors of the first and the second transistor (T1, T2), respectively. Their collectors are each connected to one of the current sources (I1, I2).

In such a generator, the collector voltage of T1, written Vc(T1), is equal to the base voltage of T3, written Vb(T3), minus the base-emitter voltage of T4, written Vbe(T4): Vc(T1)=Vb(T3)−Vbe(T4). Similarly, it is true for T2 that: Vc(T2)=Vb(T3)−Vbe(T5). If T4 and T5 are identical, then Vc(T1)=Vc(T2). In addition, the collector-base voltages of T1 and T2, written Vcb(T1) and Vcb(T2), respectively, are equal to zero, because Vb(T1)=Vb(T2)=Vb(T3)−Vbe(T3). The transistors T1 and T2 are accordingly both biased so as to have a particularly stable point of operation.

Figure 2:
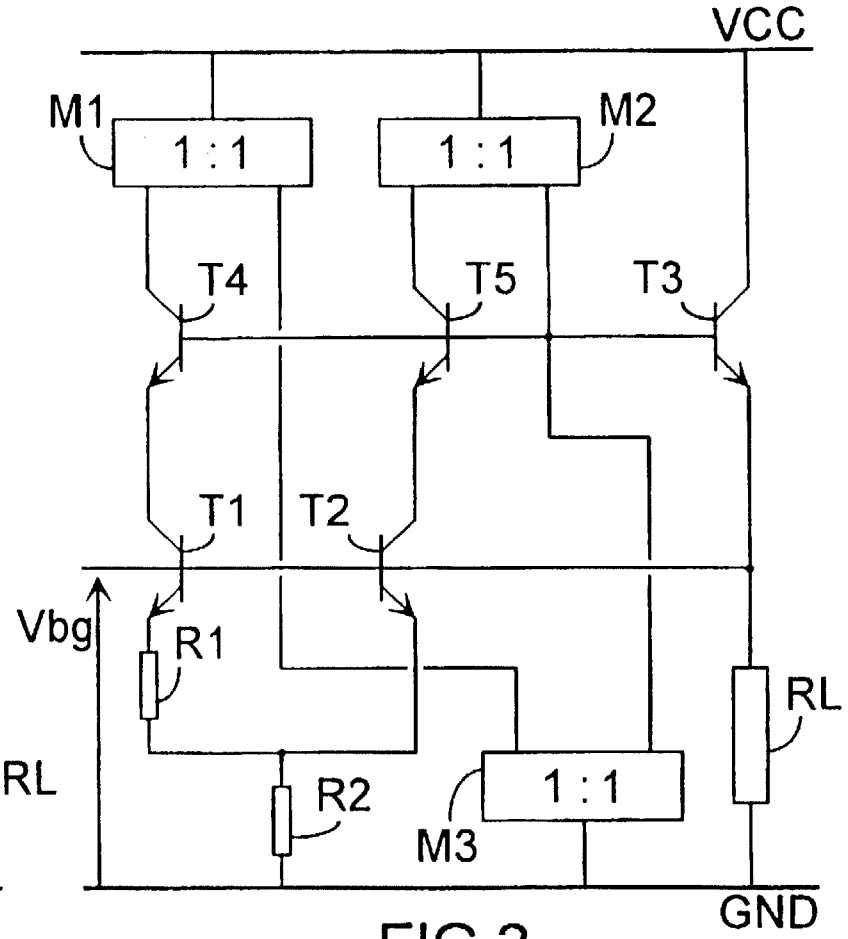
FIG. 2 is a circuit diagram representing a voltage generator in accordance with a variant of the invention.

FIG. 2 is a circuit diagram representing a voltage generator according to a variant of the invention, comprising a first, a second, and a third current mirror (M1, M2, and M3), each having a first and a second branch and a supply point. The first branches of the first and the second current mirror (M1, M2) are connected to the collectors of the fourth and the fifth transistor (T4, T5), respectively. The supply points of the first and of the second current mirror (M1, M2) are connected to the second supply terminal VCC. The second branches of the first and of the second current mirror (M1, M2) are connected to the first and the second branch, respectively, of the third current mirror M3, whose supply point is connected to the first supply terminal GND. The bases of the first, second, and third transistors (T1, T2 and T3) are jointly connected to the second branch of the third current mirror M3.

Such a structure ensures that the currents flowing through the first and the second transistor (T1, T2) are equal, which is necessary for a good control of the output voltage Vbg as a function of the temperature.

Figure 3:
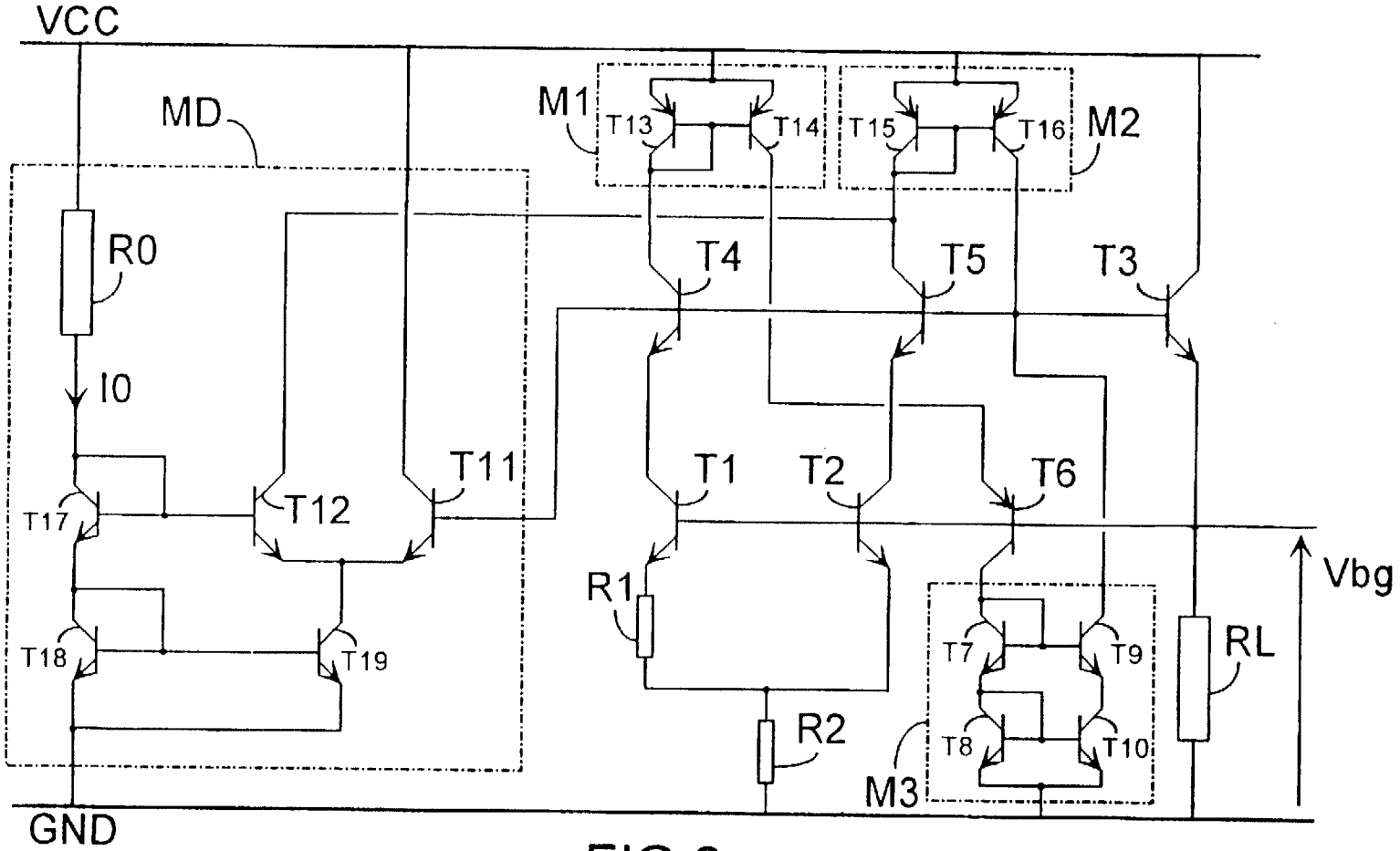
FIG. 3 is a circuit diagram representing a voltage generator according to a preferred embodiment of the invention.

FIG. 3 is a circuit diagram representing a voltage generator according to a preferred embodiment of the invention, comprising between the second branch of the first current mirror M1 and the first branch of the third current mirror M3 a sixth transistor T6, of the PNP type, whose base is connected to the emitter of the third transistor T3.

The potential of the second branch of the first current mirror M1 is equal to Vbg+Vbe(T6), while the potential of the second branch of the second current mirror M2 is equal to Vbg+Vbe(T3). The values of the voltages Vbe of the various transistors are very close to one another in such a circuit. Thanks to this additional transistor T6, the potentials of the second branches of the first and the second current mirror (M1, M2) are accordingly identical, which further improves the equality of the currents flowing through the first and the second transistor (T1, T2).

In the voltage generator shown in FIG. 3, the third current mirror M3 comprises a seventh, an eighth, a ninth, and a tenth transistor (T7, T8, T9, and T10). The bases of the seventh and the eighth transistor (T7, T8) are connected to their respective collectors and to the bases of the ninth and the tenth transistor (T9, T10). The emitters of the seventh and the ninth transistor (M7, T9) are connected to the collectors of the eighth and the tenth transistor (T8, T10), respectively, while the emitters of the latter two are interconnected and form the supply point of the third current mirror M3. The collectors of the seventh and the ninth transistor (T7, T9) form the first and the second branch, respectively, of the third current mirror M3. The second branch of the third current mirror is connected to the base of the third transistor T3.

From current entering into the second branch of the current mirror M3 are taken the base currents of the third, the fourth, and the fifth transistor. The asymmetrical structure of the current mirror M3 as described above renders it possible to compensate for these losses, because the base currents of the transistors contained in the current mirror M3 are pulled from the current entering into the first branch, thus re-establishing the symmetry between the two input currents and improving the equality of the currents flowing through the first and second transistor and resulting from reflections of the currents entering the current mirror M3 and coming from the mirrors M1 and M2. The current mirrors M1 and M2 are here formed by the transistors T13, T14 and T15, T16, respectively, all four of the PNP type.

If the output voltage Vbg of such a generator is 1.2 V, the minimum supply voltage VCC which is, for example, equal to Vbg+Vbe(T4)–$Vce_{sat}$(T13), with Vbe(T14) and $Vce_{sat}$ (T13) being of the order of 0.6 V and 0.2 V, respectively, will thus be close to 2 V, which enables the generator to consume little power and which renders it particularly suitable for applications in portable equipment such as cordless telephones.

The voltage generator shown in FIG. 3 in addition comprises a starting module MD which enables it to evolve rapidly into a stabilized state after being switched on. The module MD comprises an eleventh and a twelfth transistor (T11, T12), both of the NPN type and arranged as a differential pair. The collector of the eleventh transistor T11 is connected to the second supply terminal VCC, while its base is connected to the bases of the third, the fourth, and the fifth transistor (T3, T4, T5). The collector of the twelfth transistor T12 is connected to the first branch of the second current mirror M2, while its base is connected to the second supply terminal VCC via a resistor R0. The base of the twelfth transistor T12 is in addition connected to the base of a seventeenth transistor T17, of the NPN type and connected as a diode, whose emitter is connected to the first supply terminal GND via an eighteenth transistor T18 which is of the NPN type. The eighteenth transistor T18 is arranged so as to form a current mirror with a nineteenth transistor T19, of the NPN type, whose collector is connected to the emitters of the eleventh and the twelfth transistor (T11, T12). The resistor R0 passes a fixed current I0 whose value is (VCC–2*Vbe)/R0. This current is reproduced by the current mirror (T18, T19) and thus polarizes the differential pair (T11, T12). The base of the third transistor is permanently at a potential equal to 2*Vbe. In the starting phase, the output voltage Vbg of the generator is equal to zero. The voltage applied to the base of the eleventh transistor T11 is accordingly much lower than 2*Vbe, and the twelfth transistor T12 conducts the current I0. This current is reproduced by the mirror M2 and renders the third transistor T3 conducting, the latter then conducting a current towards the charge resistor RL, which accordingly raises the output voltage Vbg. The current I0 reproduced by the mirror M2 also makes the fourth and the fifth transistor (T4, T5) conducting while the current I0, reflected by successive mirrors M3 and M2, is passed to the first transistor T1. When the output voltage Vbg of the generator has been stabilized, the base of the eleventh transistor T11 is at a potential whose value is of the order of Vbg+Vbe. The controlled voltage Vbg itself is of the order of 2*Vbe, so that the voltage applied to the base of the eleventh transistor T11 is now higher than 2*Vbe, which is the voltage applied to the base of the twelfth transistor T12. The latter becomes non-conducting, thus disconnecting the starting module MD from the rest of the generator.

I claim:

1. A reference voltage generator which supplies a controlled output voltage at an output terminal, which the generator comprises:

a first and a second transistor whose bases are interconnected and form the output terminal of the generator, the emitter of the first transistor being connected via a first resistor to the emitter of the second transistor, which latter emitter is also connected via a second resistor to a first supply terminal, while the collectors of the first and the second transistor are connected to two current sources of equal nominal values, a third transistor whose base is connected to one of the current sources, whose collector is connected to a second supply terminal, and whose emitter is connected to the bases of the first and the second transistor as well as to the first supply terminal via a charge resistor, which generator is characterized in that it comprises, inserted between the first and second transistors and the current sources, a fourth and a fifth transistor whose bases are jointly connected to the base of the third transistor, whose emitters are connected to the respective collectors of the first and the second transistor, and whose collectors are each connected to one of the current sources.

2. A reference voltage generator as claimed in claim 1, characterized in that it comprises a first, a second, and a third current mirror, each comprising a first and a second branch and a supply point, the first branches of the first and the second current mirror being connected to the collectors of the fourth and the fifth transistor, respectively, while the supply points of the first and the second current mirror are connected to the second supply terminal, the second branches of the first and of the second current mirror are connected to the first and to the second branch, respectively, of the third current mirror, whose supply point is connected to the first supply terminal, and the bases of the first, the second, and the third transistor are jointly connected to one of the branches of the third current mirror.

3. A reference voltage generator as claimed in claim 2, characterized in that it comprises a sixth transistor whose base is inserted to the emitter of the third transistor and which is connected between that one of the branches of the first or second current mirror which is not connected to the base of the third transistor and that one of the branches of the third current mirror which is not connected to the base of the third transistor.

4. A reference voltage generator as claimed in claim 3, characterized in that it comprises a starting module which enables the generator to evolve rapidly into a stabilized state after a supply voltage has been applied to the generator, which module comprises a seventh and an eighth transistor arranged as a differential pair, the collector of the seventh transistor being connected to the second supply terminal, the base of the seventh transistor being connected to the bases of the third, the fourth, and the fifth transistor, the collector of the eighth transistor being connected to the first branch of that one from the first and second current mirrors of which the second branch is connected to the base of the third transistor, while the base of the eighth transistor receives a voltage of a nominal fixed value lower than the voltage which is applied to the bases of the third, fourth, and fifth transistors when the generator is in the nominal operational state.

5. A reference voltage generator as claimed in claim 3, characterized in that the third mirror current comprises a seventh, an eighth, a ninth, and a tenth transistor, the bases of the seventh and the eighth transistor being connected to their respective collectors and to the bases of the ninth and the tenth transistor, the emitters of the seventh and the ninth transistor being connected to the respective collectors of the eighth and the tenth transistor, of which the emitters are interconnected and constitute the supply point of the third current mirror, while the collectors of the seventh and the ninth transistor form the first and the second branch, respectively, of the third current mirror, the second branch of the third current mirror being connected to the base of the third transistor.

6. A reference voltage generator as claimed in claim 5, characterized in that it comprises a starting module which enables the generator to evolve rapidly into a stabilized state after a supply voltage has been applied to the generator, which module comprises an eleventh and a twelfth transistor arranged as a differential pair, the collector of the eleventh transistor being connected to the second supply terminal, the base of the eleventh transistor being connected to the bases of the third, the fourth, and the fifth transistor, the collector of the twelfth transistor being connected to the first branch of that one from the first and second current mirrors of which the second branch is connected to the base of the third transistor, while the base of the twelfth transistor receives a voltage of a nominal fixed value lower than the voltage which is applied to the bases of the third, fourth, and fifth transistors when the generator is in the nominal operational state.

7. A reference voltage generator as claimed in claim 2, characterized in that the third mirror current comprises a sixth, a seventh, an eighth, and a ninth transistor, the bases of the sixth and the seventh transistor being connected to their respective collectors and to the bases of the eighth and the ninth transistor, the emitters of the sixth and the eighth transistor being connected to the respective collectors of the seventh and the ninth transistor, of which the emitters are interconnected and constitute the supply point of the third current mirror, while the collectors of the sixth and the eighth transistor form the first and the second branch, respectively, of the third current mirror, the second branch of the third current mirror being connected to the base of the third transistor.

8. A reference voltage generator as claimed in claim 2, characterized in that it comprises a starting module which enables the generator to evolve rapidly into a stabilized state after a supply voltage has been applied to the generator, which module comprises a sixth and a seventh transistor arranged as a differential pair, the collector of the sixth transistor being connected to the second supply terminal, the base of the sixth transistor being connected to the bases of the third, the fourth, and the fifth transistor, the collector of the seventh transistor being connected to the first branch of that one from the first and second current mirrors of which the second branch is connected to the base of the third transistor, while the base of the seventh transistor receives a voltage of a nominal fixed value lower than the voltage which is applied to the bases of the third, fourth, and fifth transistors when the generator is in the nominal operational state.

* * * * *